US012055371B2

(12) United States Patent
Hamnett

(10) Patent No.: US 12,055,371 B2
(45) Date of Patent: Aug. 6, 2024

(54) COUNTERMEASURE

(71) Applicant: MBDA UK Limited, Hertfordshire (GB)

(72) Inventor: Luke A. Hamnett, Hertfordshire (GB)

(73) Assignee: MBDA UK Limited, Hertfordshire (GB)

( * ) Notice: Subject to any disclaimer, the term of this patent is extended or adjusted under 35 U.S.C. 154(b) by 0 days.

(21) Appl. No.: 17/770,534

(22) PCT Filed: Oct. 22, 2020

(86) PCT No.: PCT/GB2020/052661
§ 371 (c)(1),
(2) Date: Apr. 20, 2022

(87) PCT Pub. No.: WO2021/079123
PCT Pub. Date: Apr. 29, 2021

(65) Prior Publication Data

US 2022/0390216 A1 Dec. 8, 2022

(30) Foreign Application Priority Data

Oct. 25, 2019 (GB) ..... 1915500

(51) Int. Cl.
*F42B 12/56* (2006.01)
*F41H 11/02* (2006.01)

(52) U.S. Cl.
CPC ..... *F42B 12/56* (2013.01); *F41H 11/02* (2013.01)

(58) Field of Classification Search
CPC ..... F42B 12/56; F41H 11/02
(Continued)

(56) References Cited

U.S. PATENT DOCUMENTS

2017/0261292 A1* 9/2017 Armstrong ..... F41H 11/02
2018/0103036 A1* 4/2018 Fox ..... H04W 4/40
(Continued)

FOREIGN PATENT DOCUMENTS

CZ 2005488 A3 2/2007
WO 2019/074573 A1 4/2019

OTHER PUBLICATIONS

International Search Report and Written Opinion issued in corresponding International Patent Application No. PCT/GB2020/052661, mailed Feb. 9, 2021, 8 pages.
(Continued)

*Primary Examiner* — Samir Abdosh
(74) *Attorney, Agent, or Firm* — DAY PITNEY LLP; George N. Chaclas; Anthony A. Kassas

(57) ABSTRACT

A countermeasure (200) for use against a vehicle having an electric motor comprising at least one magnet. The countermeasure (200) comprises an ejection system (205) comprising a plurality of pieces of magnetic material (203). The ejection system (205) is configured to release the plurality of pieces (203) in response to receipt of a trigger signal (209). Also a method of disrupting the operation of a vehicle having an electric motor comprising at least one magnet using an ejection system (205) containing a plurality of pieces (203) of magnetic material. The method comprises detecting the vehicle; receiving, at the dispersal system, a trigger signal (209); in response to the receipt of the trigger signal (209), the ejection system (205) releasing the plurality of pieces (203); some of the plurality of pieces (203) being attracted to the magnet, sticking to the magnet, and thereby obstructing the motor.

20 Claims, 6 Drawing Sheets

(58) Field of Classification Search
USPC ..... 102/504
See application file for complete search history.

(56) References Cited

U.S. PATENT DOCUMENTS

| | | | | |
|---|---|---|---|---|
| 2020/0001369 | A1* | 1/2020 | Nakaseko | H01F 1/15341 |
| 2022/0026179 | A1* | 1/2022 | Kolanek | G01S 13/426 |

OTHER PUBLICATIONS

Search Report issued in corresponding Great Britain Patent Application No. GB1915500.1, mailed Apr. 20, 2020, 3 pages.
EP Communication Pursuant to Article 94(3) EPC corresponding to Application No. 20800256.8, dated Mar. 13, 2024, 12 pages.

* cited by examiner

COUNTERMEASURE

This application is a U.S. national stage application under 35 U.S.C. 371 of co-pending International Application No. PCT/GB2020/052661 filed on Oct. 22, 2020, which in turn claims priority to GB Patent Application No. 1915500.1 filed on Oct. 25, 2019, the contents of which are incorporated by reference herein in their entirety for all purposes.

TECHNICAL FIELD

The present invention concerns electric-vehicle countermeasures. More particularly, but not exclusively, this invention concerns a countermeasure for and a method of disrupting the operation of a vehicle having an electric motor.

BACKGROUND

Unmanned vehicles are typically propelled by use of electric motors; often brushless DC motors. FIG. 1 shows a schematic view of a typical brushless DC motor 100 of the prior art. The motor 100 comprises a rotor 101 and a stator 103 separated by a small air gap 105. The rotor 101 comprises a magnet. The stator 103 comprises a plurality, six in this example, of electric coils 107. The skilled person will appreciate that, in other motor designs, the rotor 101 may comprise a plurality of coils 107 and the stator comprises one or more magnets. The rotor 101 is driven to rotate relative to the stator 103 by exciting the coils 107 with commutating electric currents. Such a motor 100 may be used to propel an Unmanned Air System (UAS), for example by driving a propeller, or an unmanned ground vehicle, for example by driving a wheel or track. Such motors may also be used to propel manned vehicles. Such motors 100 are typically air-cooled and therefore comprise one or more air vents to allow air to circulate through the motor.

Whilst unmanned vehicles have historically been used by governments and militaries, developments in technology have enabled the production of remotely controllable unmanned vehicles in large numbers and at relatively low cost. UAS (also known as drones) in particular have, in recent years, become increasingly accessible to the general public.

Highly sophisticated countermeasures for use against UAS have been proposed, however these are usually designed to counter military-grade UAS which are often higher performing and/or equipped with more sophisticated systems than the type of low cost UAS accessible to the general public (referred to hereafter as commercially available drones). Such countermeasures may be correspondingly expensive and/or complex. It would be advantageous to provide a simpler and/or more cost effective solution to the problem of UAS, for example tailored for use against commercially available drones.

Additionally or alternatively, it would be useful to provide a simpler and/or more cost effective countermeasure for use against vehicles that use electric motors.

The present invention seeks to mitigate the above-mentioned problems. Alternatively or additionally, the present invention seeks to provide an improved countermeasure for and method of disrupting the operation of an unmanned vehicle.

SUMMARY

The present invention provides, according to a first aspect, a countermeasure for use against a vehicle having an electric motor comprising at least one magnet. The countermeasure comprises a dispersal system. The dispersal system may comprise, for example contain, a plurality of pieces of magnetic material. The dispersal system may be configured to release the plurality of pieces in response to a trigger signal.

Thus, countermeasures in accordance with the present invention may disable an electric motor by dispersing a plurality of pieces of magnetic material. The pieces, once dispersed, are magnetically attracted to the magnet in the electric motor and may therefore be ingested into the motor, for example via an air vent. The plurality of pieces may then accumulate on the magnet and thereby disrupt operation of the motor. This may provide a mechanically simple and cost effective way of disrupting the operation of a vehicle with an electric motor.

The electric motor may further comprise a rotor, a stator, and an air gap between the rotor and the stator. The magnet may be located on the rotor and/or the stator. The plurality of pieces may obstruct the motor by at least partially filling the air gap. The plurality of pieces may entirely block the motor, such that the rotor can no longer rotate. Alternatively, the plurality of pieces may inhibit rotation of the motor, such that the rotor may still rotate but only at a reduced speed. Embodiments of the invention may therefore provide a countermeasure capable of disrupting operation of an electric motor and the vehicle in which such a motor is used.

The countermeasure may comprise a control system configured to generate a trigger signal. The control system may be configured to generate a trigger signal in dependence on one or more trigger condition(s) being met. The control system may be configured to determine that the countermeasure has been initiated, for example launched.

The countermeasure may comprise a fuse. It will be appreciated that the fuse may be implemented in software and/or hardware. The fuse may be configured to generate the trigger signal. The fuse may comprise a proximity fuse. The proximity fuse may be configured to generate the trigger signal in response to detecting that a distance to the vehicle has fallen below a pre-determined threshold. The fuse may comprises a time-delay fuse. The time-delay fuse may be configured to generate the trigger signal in response to a pre-determined period of time having elapsed since initiation of the countermeasure, for example launch of the countermeasure.

The dispersal system may be configured to create a burst, for example an air or ground burst, of the plurality of pieces. The dispersal system may be configured to eject (or propel) the plurality of pieces away from the dispersal system, for example to propel the plurality of pieces away from the dispersal system along a plurality of different vectors. It may be that releasing the plurality of pieces comprises creating an airburst or ground burst of the plurality of pieces. Embodiments which are configured to actively eject the plurality of pieces may provide a countermeasure having a larger area of effect, as the plurality of pieces are spread across a greater distance.

The dispersal system may be an active dispersal system, that is to say a dispersal system configured to actively eject (e.g. propel) the plurality of pieces. The dispersal system may comprise an ejection system configured to eject (or propel) the plurality of pieces from the dispersal system, for example from a container containing the pieces. The ejection system may be mounted on the dispersal system. The ejection system may be configured to impart kinetic energy to the plurality of pieces. The ejection system may comprise one or both of a pyrotechnic charge and pressurised gas.

Additionally or alternatively, the ejection system may comprise a mechanism, for example comprising one or more links and/or springs (e.g. elastically deformable elements) configured to eject the plurality of pieces from the dispersal system. Thus, the dispersal system may actively eject the plurality of pieces. Such embodiments can be said to comprise an active dispersal system. Embodiments comprising an active dispersal system may be capable of dispersing the plurality of pieces more quickly and over a larger target area.

The dispersal system may be configured to simply release the plurality of pieces, rather than actively ejecting them. In such embodiments, the plurality of pieces may, for example, be dispersed by gravity or by centrifugal force due to a rotation of the dispersal system (or container) as discussed in more detail below. It may be that the dispersal system does not comprise an ejection system. Such embodiments can be said to comprise a passive dispersal system. Embodiments comprising passive dispersal systems may provide effective dispersal of the plurality of pieces without the need for pyrotechnics or pressurised gas, each of which may present a hazard to people handling the countermeasure. Additionally or alternatively, such countermeasures may be mechanically simpler and/or more cost effective than active dispersal systems.

The pieces of magnetic material may comprise one or both of ferromagnetic and ferrimagnetic materials. Both ferromagnetic and ferrimagnetic materials are attracted to magnets. Therefore, in such embodiments, the plurality of pieces will be attracted towards the magnet in the target motor, which may increase the number of pieces ingested into the motor and thereby the inhibitive effect of the countermeasure on the action of the motor.

The pieces of magnetic material may comprise, consist of, consist essentially of and/or be made from iron. Iron is considered safe for humans to ingest and to inhale in small quantities. Iron is a naturally occurring element, and therefore the dispersal of iron filings may have little lasting environmental impact. Iron filings also have no significant lasting effects on the electromagnetic spectrum, once dispersed. A countermeasure in which the plurality of pieces are made of iron may therefore be safe to use in urban and populated areas where there is an otherwise high risk of collateral damage.

For example the pieces of magnetic material may comprise iron filings. Iron filings provide a cheap and readily available source of suitable pieces of magnetic material. Such embodiments may therefore be cheaper to manufacture.

The pieces may be sized and/or shaped to be ingested into the electric motor. In some embodiments, each of the plurality of pieces 203 has a maximum length of less than 2.5 mm, preferably 1 mm, more preferably less than 0.5 mm, yet more preferably less than 0.25 mm. In some embodiments, each of the plurality of pieces has a maximum length of less than 0.025 mm, preferably 0.05 mm, more preferably 0.1 mm, yet more preferably 0.5 mm. The plurality of pieces may be of non-uniform size and/or shape. It may be that certain sizes and designs of electric motor are particularly susceptible to pieces of a given size and/or shape. Therefore, embodiments in which the plurality of pieces vary in size and/or shape may provide a countermeasure which is broadly effective against a range of motor sizes and designs.

The magnet may be an electromagnet or, preferably, a permanent magnet. The electric motor may comprise one of: an AC motor, a DC motor, a brushless AC motor, or preferably a brushless DC motor, and a permanent-magnet synchronous motor. Permanent magnets are commonly used in small electric motors. In particular, brushless DC motors are commonly used on small UASs. The present invention may be particularly useful for protecting against small UASs (such as a class 1 UAS) due to their wide general availability and the resulting likelihood of their use in populated areas.

The dispersal system may comprise a container in which the plurality of pieces are contained. The container may be defined by one or more walls. The container may comprise one or more openings via which the plurality of pieces can be released from the container. The dispersal system may comprise one or more lids mounted for movement relative an opening between a first position in which the lid covers the opening and a second position in which the lid does not cover the opening, such that the plurality of pieces can leave the container. Each lid may be mounted on the dispersal system, for example on the container. Thus, for example in a passive system, releasing the plurality of pieces may comprise opening one or more lids. Additionally or alternatively, the countermeasure may comprise a frangible portion, for example the whole or a portion of the container, for example the wall(s) defining the container, may be frangible. Thus, releasing the plurality of pieces may comprise breaking the container in which the pieces are contained. The ejection system of the countermeasure may be configured to break one or more frangible portions of the container. For example the countermeasure may comprise an explosive (pyrotechnic) or gas propelled charge configured to simultaneously break the frangible portions and eject the plurality of pieces. The ejection system may be located at least partly within the container.

The container may be mounted for movement relative to a base of the dispersal system. The countermeasure may comprise means configured to move the container relative to the base, either in a rotational or translational sense. For example the dispersal system may comprise one or more motors and/or mechanisms configured to rotate and or translate the container relative to the base of the dispersal system. Thus, dispersing the plurality of pieces may comprise moving, for example rotating and/or translating the container relative to a base of the dispersal system such that the plurality of magnetic pieces exit the container.

The countermeasure may comprise a launch platform. For example, the dispersal system may be releasably mounted on the launch platform.

The control system may be configured to release the dispersal system from the launch platform in response to an input from a user or a command and control system. The control system may be configured to detect that the dispersal system has been launched from the launch platform. For example the control system may be configured to detect the loss of a contention signal received by the control system from a launch platform. The control system may comprise an accelerometer configured to measure acceleration of the dispersal system. The control system may be configured to detect, in dependence on the signal received from the accelerometer, whether an acceleration threshold has been met. The acceleration threshold may corresponding to the acceleration experienced on launch, for example on firing of a grenade comprising the dispersal system from a grenade launcher or during launching of a missile comprising the dispersal system. The countermeasure may be configured to propel the dispersal system away from the launch platform. For example the countermeasure may comprise a pyrotechnic charge, compressed gas charge, ejection mechanism and/or motor, for example mounted on the launch platform and/or the dispersal system, configured to propel the dispersal system away from the launch platform.

The countermeasure may be mounted on a missile or an aircraft. Thus, the launch platform may be a missile and/or aircraft.

The countermeasure may form part of a grenade, for example one suitable for launch from a grenade launcher. The plurality of magnetic pieces may be contained within the body of the grenade. The ejection system may comprise the detonating mechanism of the grenade. The control system may comprise a firing pin of a grenade. The launch platform may be a grenade launcher.

Thus, countermeasures in accordance with the present invention may find applicability across different scales e.g. small scale grenades and much larger missile-mounted systems.

According to a second aspect of the invention there is provided a missile comprising a countermeasure according to the first aspect. The missile may further comprise one or more of, a seeker, a motor, a controller and one or more control surfaces. It may be that the seeker is configured to detect and track a target vehicle. The control surfaces may be controlled by the controller in response to signals from the seeker to guide the missile to the target vehicle. The motor may be configured to provide propulsion for the missile. The missile may be configured to provide the trigger signal to the countermeasure. For example, the control system may provide a trigger signal to the countermeasure in dependence on input from the seeker.

According to a third aspect of the invention there is provided a method of disrupting the operation of a vehicle having an electric motor comprising at least one magnet using a countermeasure comprising a dispersal system. The dispersal system may contain a plurality of pieces of magnetic material. The method may comprise one or more of the following steps; detecting a vehicle; receiving at the dispersal system a trigger signal; in response to the trigger signal so received, the dispersal system releasing the plurality of pieces; at least some, for example the majority, of the plurality of pieces being attracted to the magnet and thereby obstructing the motor.

The method may comprise detecting the vehicle, for example visually (for example by a human operator) identifying the vehicle and/or detecting the vehicle using radar, lidar, infra-red detection and/or other detection systems. The method may comprise launching the countermeasure in response to detecting the vehicle and/or sending a trigger signal to the countermeasure in response to detecting the vehicle.

The method may comprise generating a trigger signal. A control system of the countermeasure may generate a trigger signal that is sent to the dispersal system or a trigger signal may be received from an external system and/or user. The control system may generate the trigger signal in response to one or more trigger conditions being met.

The vehicle may comprise an aircraft. The vehicle may comprise one of a rotary wing aircraft, for example a quadcopter, and a fixed wing aircraft. Aircraft may be particularly susceptible to the countermeasure of the invention because the continued operation of their electric motors is necessary to maintain flight. An aircraft suffering from the loss of a single electric motor is unlikely to be able to continue to fly. Such an aircraft will be highly likely to, at the very least, suffer from greatly reduced performance.

The vehicle may comprise an unmanned air system. It may be that the unmanned air system is a class 1 UAS. The unmanned air system may be less than 9 kg in mass. It may be that the unmanned air system is a class 2 UAS. The unmanned air system may be less than 25 kg in mass. The unmanned air system may be greater than 1 kg in mass.

The method may comprise launching the dispersal system. For example, where the countermeasure comprises a grenade launching the dispersal system may comprise firing the grenade from a grenade launcher and/or a user arming and throwing the grenade. In the case that elements of the countermeasure are mounted on a missile, launching the dispersal system may comprise launching the missile. In the case that elements of the countermeasure are mounted on an aircraft, launching the dispersal system may comprise releasing the dispersal system from the aircraft.

The method may further comprise detecting that a trigger condition has been met, for example the control system detecting that a trigger condition has been met. The method may comprise, in response to the detecting, transmitting the trigger signal to the dispersal system. Detecting that the trigger condition has been met may comprise determining that a distance to the vehicle has fallen below a predetermined threshold. Detecting that the trigger condition has been met may comprise determining that a pre-determined period of time has elapsed since the countermeasure was launched. Launch may be detected by determining that the countermeasure has undergone an acceleration greater than a predetermined threshold. Alternatively or additionally, launch may be detected by sensing the loss or absence of a connection signal received by the countermeasure from a launch platform.

The plurality of pieces being attracted to the magnet may comprise the pieces being ingested into the electric motor through an air intake. Many electric motors, and particularly small and/or low cost electric motors, are air-cooled so incorporate air vents. These air vents can provide an aperture by which the pieces can enter the electric motor.

Releasing the plurality of pieces may comprise propelling the plurality of pieces away from the dispersal system, for example using an ejection system as described above. Releasing the plurality of pieces may comprise creating a burst, for example an airburst or groundburst, to disperse the plurality of pieces. The dispersal system may comprise a pyrotechnic charge and creating the airburst may comprise detonating the pyrotechnic charge. The dispersal system may comprise a container of pressurised gas and creating the airburst may comprise releasing the pressurised gas. Embodiments in which the pieces are released in an airburst may provide wider dispersal of the plurality of pieces and thereby a larger area of effect of the countermeasure.

Creating an airburst may comprise launching the dispersal system into the air, prior to releasing the plurality of pieces of magnetic material.

Releasing the plurality of pieces may comprise opening a lid(s) to allow the plurality of pieces to leave the dispersal system. Releasing the plurality of pieces may comprise breaking a container in which the plurality of pieces is located, for example using an explosive charge, for example a pyrotechnic or compressed gas charge.

It will of course be appreciated that features described in relation to one aspect of the present invention may be incorporated into other aspects of the present invention. For example, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings of which.

DETAILED DESCRIPTION

Figure 2:
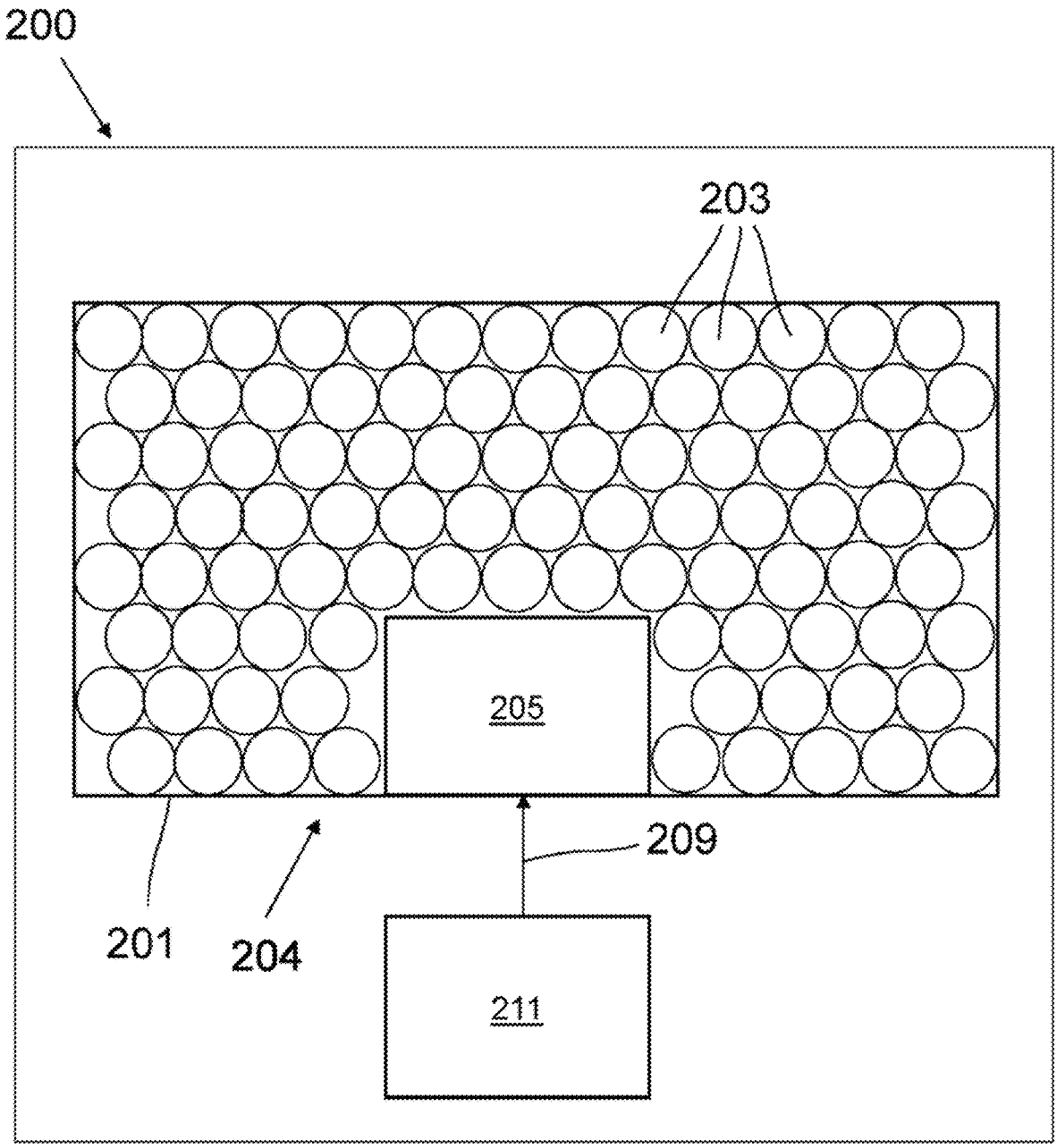
FIG. 2 shows a schematic view of a countermeasure according to a first embodiment of the invention.

FIG. 2 shows a schematic view of a countermeasure 200 according to a first embodiment of the invention. The countermeasure 200 comprises a container 201 holding a plurality of pieces 203 of magnetic material. The container 201 is arranged to receive and retain the plurality of pieces 203.

In this example embodiment, the pieces 203 comprise iron filings. However, it will be appreciated that the pieces 203 need not necessarily be filings. In alternative embodiments, the pieces 203 may comprise one or more of filings, shavings, chips, ball bearings, and swarf. It may be that the pieces 203 are a by-product of a filing or machining operation. Alternatively, the pieces 203 may be specifically manufactured for use in the countermeasure. It will be appreciated that the plurality of pieces 203 need not necessarily all be the same, and therefore that the plurality of pieces could comprise any combination of the above described alternatives.

In alternative embodiments, the pieces 203 may be made of materials other than iron. In such embodiments, the pieces may be formed of any magnetic material, for example iron, nickel, cobalt, or aluminium. In some embodiments, the pieces are formed of one or both of ferromagnetic and ferrimagnetic materials. Ferromagnetic and ferrimagnetic materials are both attracted to magnets. Thus, in some embodiments in which the pieces comprise one or both of ferromagnetic and ferrimagnetic materials, a greater number of the pieces may be ingested into the motor due to their attraction to the magnet in the motor. Such embodiments may therefore provide a more reliable and/or effective countermeasure. Again, the plurality of pieces 203 need not necessarily be uniform and, in some embodiments, may comprise a mixture of pieces formed of different materials. Additionally or alternatively, countermeasures in accordance with the present embodiments may provide a mechanically simple and/or cost effect countermeasure for use against vehicles with electric motors, for example drones.

Figure 1:
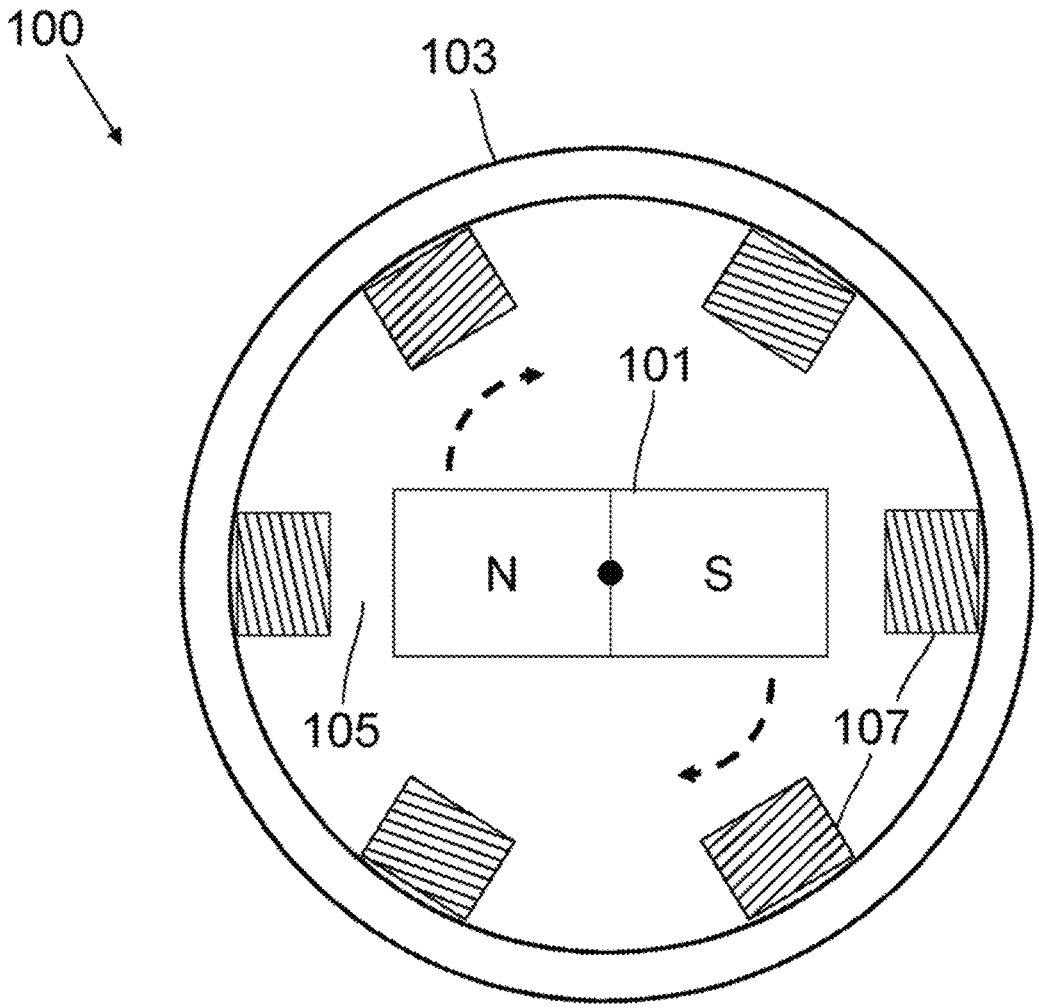
Fig. 1 (PRIOR ART)
FIG. 1 shows a schematic view of a typical brushless DC motor of the prior art.

Whilst in FIG. 1 the pieces 203 of magnetic material are shown as being circular, it will be appreciated that FIG. 1 is a schematic representation of countermeasure 200 and that the pieces need not be circular or spherical. For example, the pieces 203 may be spherical, cuboidal, pyramidal, or indeed any other shape, regular or irregular. In some embodiments of the invention, the plurality of pieces 203 may be any size and shape suitable for being ingested into a target electric motor. The possible sizes and shapes of the pieces 203 is therefore determined by the size and form of the target motor and/or vehicle.

In some embodiments, each of the plurality of pieces 203 has a maximum length of less than 2.5 mm, preferably 1 mm, more preferably less than 0.5 mm, yet more preferably less than 0.25 mm. In some embodiments, each of the plurality of pieces has a maximum length of less than 0.025 mm, preferably 0.05 mm, more preferably 0.1 mm, yet more preferably 0.5 mm. In some embodiments, the plurality of pieces 203 are each of substantially identical size and shape. Embodiments in which the plurality of pieces 203 are of substantially uniform size and shape may be particularly effective against motors of a particular type and/or size. Such embodiments can therefore be said to be specialised for use against that particular type and/or size of motor. In alternative embodiments, the plurality of pieces 203 are of non-uniform size and shape. It may be that filings of certain size are more suitable for disrupting electric motors of a given size, for example depending on the size of the motor's air gap. Embodiments in which the plurality of pieces 203 vary in size and shape may therefore be suitable for use against a range of different motor types and sizes.

A pyrotechnic charge 205 is located within the container 201. In other embodiments a compressed gas charge may be used. In yet further embodiments, an ejection mechanism may be used. Pyrotechnic charge 205 is located within the container however it need not necessarily be so and, in alternative embodiments, may be located outside of the container 201 (for example adjacent to the container 201). Countermeasure 200 further comprises a control system 211 connected to pyrotechnic charge 205 to provide a trigger signal 209 to the charge. In other embodiments, control system 211 may be absent, and a user may provide a trigger signal to the pyrotechnic charge 205 directly.

In operation, the control system 211 monitors one or more conditions in order to determine that a firing condition is met. The one or more conditions may, for example, comprise a maximum distance to a target vehicle and/or a minimum elapsed time (for example, since the maximum distance criteria was satisfied). Upon detecting that the firing condition is met, the control system 211 transmits a trigger signal 209 to the pyrotechnic charge 205 causing the charge to detonate thereby dispersing the plurality of pieces 203 of magnetic material. The pieces 203 are attracted to the magnet in the electric motor of the target vehicle, entering the electric motor through an air intake in the motor. The pieces 203 then stick to and build up on the magnet, filling the air gap between the rotor and the stator and thereby physically obstructing rotation of the rotor. Thus, the electric motor is no longer able to turn and therefore can no longer propel the target vehicle. Such embodiments can be said to actively eject the plurality of pieces 203 from the container 201, and therefore to comprise an active dispersal system. In some embodiments, the pieces 203 do not stick directly to the magnet, but instead stick to an intervening material. For example, the magnet may be covered by non-magnetic sheath. In such a case, the magnetic field generated by the magnet may permeate through the sheath and thus the pieces 203 are still attracted to the magnet. Therefore, rather than directly sticking to the magnet, the pieces 203 may instead stick to the sheath, where they may still obstruct rotation of the motor.

In example embodiments, the control system 211 may comprise a fuse. In some embodiments, the fuse 211 may comprise a proximity fuse. Thus, the fuse 211 may be configured to generate the trigger signal 209 in response to detecting that a distance to a target vehicle has fallen below a pre-determined threshold. In such embodiments, the trigger condition comprises a maximum distance to the target vehicle. Alternatively or additionally, the fuse 211 may comprise a time-delay fuse. In such embodiments, the trigger condition may comprise a minimum elapsed time since launch of the countermeasure. Thus, the fuse 211 may be configured to generate the trigger signal 209 in response to a pre-determined period of time having elapsed since the countermeasure 200 was launch. For example, in some embodiments wherein the countermeasure forms part of a grenade, the pre-determined period of time may run from release of the safety lever of a handheld grenade or from the launch of the grenade from a grenade launcher. Thus, in some embodiments the control system 211 may receive a launch signal, for example a user input and/or input from a command and control system that activates the control system 211, the control system 211 then triggering the dispersal of the magnetic pieces once the firing condition has been met.

Launch of the countermeasure 200 may be determined by detecting the loss of a connection signal received by the countermeasure 200 from a launch platform, for example a grenade launcher or an aircraft. Alternatively or additionally, launch may be determined by detecting that the countermeasure 200 has undergone an acceleration corresponding to the launch of the countermeasure. For example, the control system 211 may be configured to determine that the countermeasure has been launched by detecting an acceleration undergone by a grenade comprising the countermeasure 200 when fired from a grenade launcher or by detecting an acceleration resulting from the firing of a motor of a missile comprising the countermeasure 200. In some embodiments, the trigger condition comprises detection of a pre-determined user input. Thus, the control system 211 may be configured to generate the trigger signal 209 in response to a received user input. In some embodiments, the trigger condition may comprise a combination of multiple of the above listed conditions. For example, in some embodiments, the control system 211 may generate the trigger signal only when both a distance to a target vehicle has fallen below a pre-determined threshold and a pre-determined period of time having elapsed since the countermeasure 200 was fired. In some embodiments, the control system 211 may be configured to also require that one or more safety related requirements be met before generating the trigger signal 209. For example, the control system 211 may be configured to only generate the trigger signal if it has previously detected an acceleration corresponding to launch of a system comprising the countermeasure 200. The required acceleration may, for example, correspond to firing of a grenade comprising the countermeasure 200 from a grenade launcher or to launching of a missile comprising the countermeasure 200.

In some embodiments, the countermeasure 200 may comprise part of or be mounted on a missile or an aircraft. For example, the countermeasure may be carried by a helicopter or by a drone. In alternative embodiments, the countermeasure 200 may comprise part of or be mounted on a projectile, for example a grenade.

In some embodiments, the countermeasure is configured to create an airburst of the plurality of pieces 203. An airburst will be understood by the skilled person to mean an airborne explosion of the plurality of pieces 203, such that the plurality of pieces are dispersed to form a cloud of the pieces 203. In such embodiments, the countermeasure may comprise means of launching the container 201 prior to release of the particles. Thus, the countermeasure may comprise a launch platform for the container. The launch platform may comprise a pyrotechnic charge, or a source of pressurised gas. Detonating the pyrotechnic charge or releasing the pressurised gas launches the container 201.

In some embodiments, the dispersal system 204 comprises a release mechanism for the container 201 such that the plurality of pieces 203 are allowed to egress the container 201, but are not actively ejected from the container 201 by ejection system 205. Such embodiments can be said to provide passive dispersal of the plurality of pieces 203, and therefore to comprise a passive dispersal system. It will be appreciated by the skilled person that, in this context, passive is intended to mean that an ejection system 205 does not comprise exert a force to propel the plurality of pieces 203 from the container 201.

Figure 3:
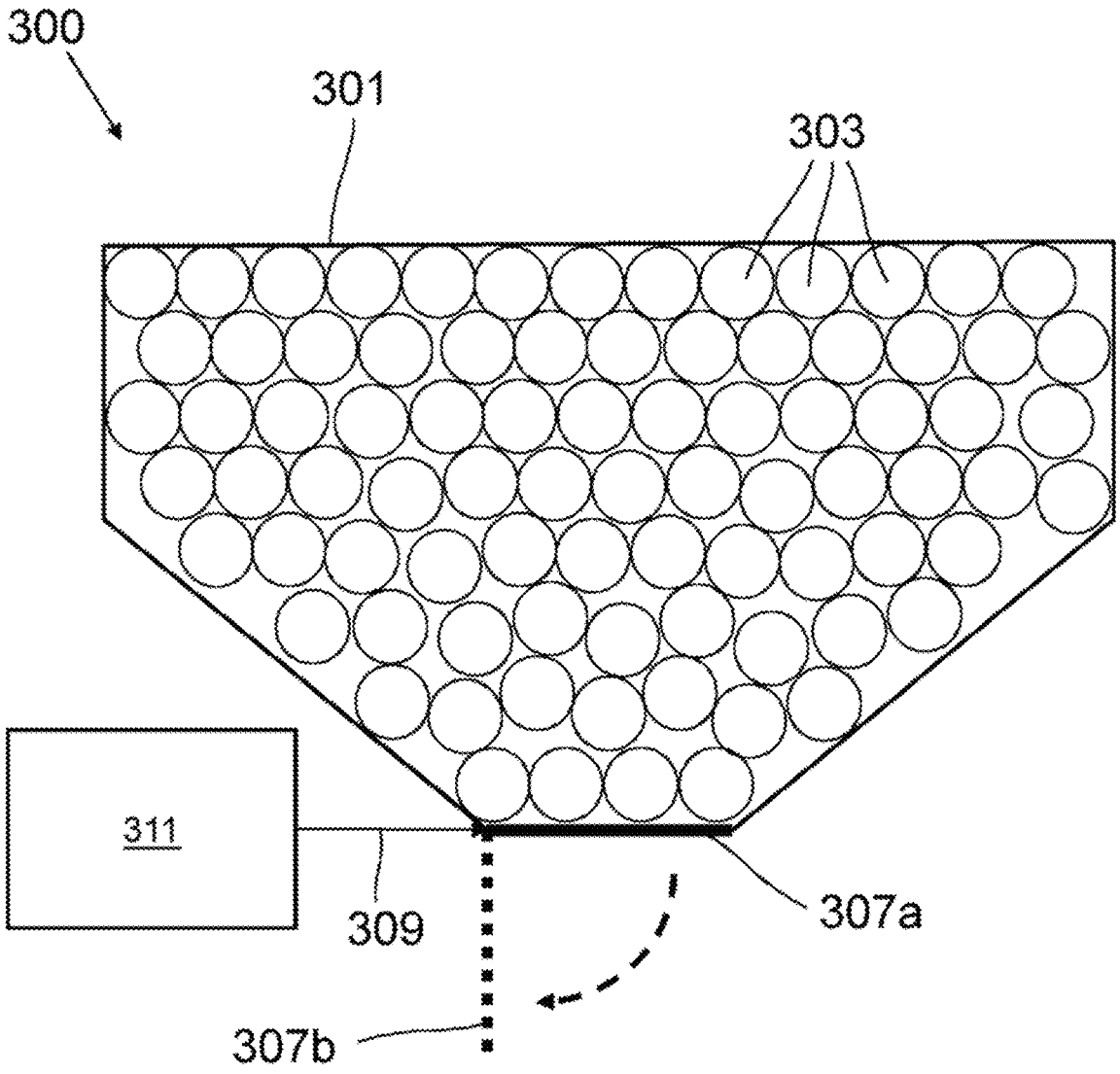
FIG. 3 shows a schematic view of a countermeasure according to a second embodiment of the invention.

FIG. 3 shows a schematic view of a countermeasure 300 according to a second example embodiment of the invention. Those elements of the second embodiment that correspond to similar elements of the first embodiment are labelled with the same reference numeral but incremented by 100.

In this example embodiment, countermeasure 300 comprises a passive dispersal system. The passive dispersal system comprises an aperture in the bottom of container 301 closed by a door 307. The door 307 is shown in a closed position 307*a*, in which the aperture is closed by the door and the plurality of pieces 303 are thereby retained in the container 301. On receipt of the trigger signal 309 from control system 311, door 307 moves to an open position 307*b*, providing an outlet by which the plurality of pieces 303 can egress the container 301. Such an embodiment may, for example, disperse the plurality of pieces by opening the aperture to allow the plurality of pieces 303 to exit the container 301 under the influence of gravity. It will be appreciated by the skilled person that the plurality of pieces 303 will exit the container 301 gradually over a period of time. It will also be appreciated that the length of time required for substantially all the plurality of pieces 303 to exit the container 301 will be determined by the number and geometry of the pieces 303 and the size of the aperture. Thus, such a passive dispersal system can be designed to release the pieces 303 at a pre-determined rate.

It may be that the dispersal of the plurality of pieces is assisted by motion of a platform carrying the countermeasure 300. For example, the countermeasure 300 may be carried on an aircraft, for example a drone. In such embodiments, motion of the aircraft over the period of time during which the plurality of pieces 303 are being released disperses the plurality of pieces 303 along a flight path of the aircraft. Thus, by controlling the flight path of the platform, it is possible to control the dispersal of the plurality of pieces to target a particular area. Such embodiments can be said to "crop-dust" a target area.

It will be appreciated that other means may also be used to provide passive dispersal of the plurality of pieces 303. For example, in alternative embodiments, the countermeasure 300 may be arranged to spin, for example due to having been launched from a rifled grenade launcher, and so eject the plurality of pieces 303 through the outlet under the centrifugal forces provided by the spin of the countermeasure 300. In other embodiments, the container 301 may be rotated and/or translated relative to a base (not shown) of the dispersal system, thereby generating forces that encourage the plurality of pieces to exit the container.

In FIG. 3, countermeasure 300 is shown as having a hinged door 307 which rotates about a hinge point between the closed position 307*a* and the open position 307*b*. However, in alternative embodiments the door 307 may be arranged to open and close in other ways, for example by sliding between the open and closed positions. Alternatively, the door 307 may comprise a frangible portion of the container 301 which, on activation of the dispersal system, is broken to provide the outlet. It will be appreciated by the skilled person that the precise means by which the outlet from container 301 is provided is not an essential feature of the invention and therefore that any other known means of providing an openable outlet from a container may also be used. Similarly, although FIG. 3 shows countermeasure 300 having only a single door 307, it will be appreciated by the skilled person that alternative embodiments may comprise any number of outlets and a corresponding number of doors.

In some embodiments, for example those in which the outlet is provided by a frangible portion of container 301, the outlet may not be closable again once opened. In such embodiments, the countermeasure 300 is a single use item. In alternative embodiments, for example those having one or more doors 307, it may be possible to close the outlet after use. In such embodiments, it may be possible to refill the container with a new plurality of pieces 303 and reset the countermeasure, allowing it to be reused.

Figure 4:
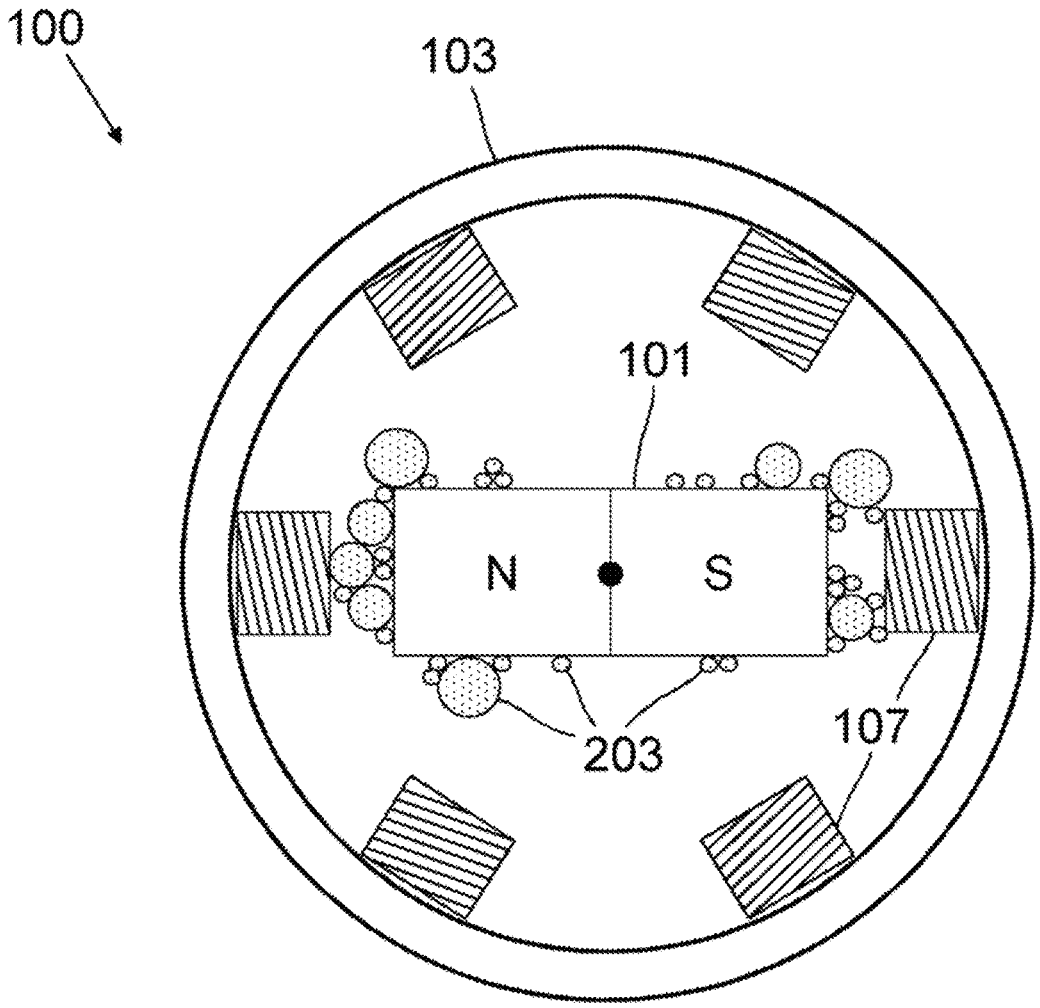
FIG. 4 shows a schematic view of the motor of FIG. 1 having been subjected to the countermeasure of the first embodiment.

FIG. 4 shows a schematic view of the prior art motor 100 of FIG. 1 having been subjected to the countermeasure 200 of the first embodiment. The plurality of pieces 203, having been released by the dispersal system and attracted to the magnet on the rotor 101, have been ingested into the motor 100 and have accumulated on the magnet of rotor 101. The build-up of pieces 203 has partially filled the air gap between the rotor 101 and the coils 107 of the stator 103, and thereby physically obstructs the rotation of the rotor 101 relative to the stator 103. In some cases, the build-up of pieces 203 may be such to entirely block rotation of the motor. In other cases, the motor may be configured to automatically shut down in the event of arrested rotation of the rotor 103 in order to prevent damage to the coils 107 by excessive electric currents. In such cases, the build-up need not necessarily entirely block rotation of the rotor 103. Instead, the build-up need only be sufficient to impede rotation of the rotor 103 to the extent necessary to initiate an automatic shut-down. In either case, the motor is no longer usable and the operation of the vehicle is disrupted. It may be that the vehicle is completely immobilised by the action of the countermeasure 200. It may be that the vehicle is still operable, but only with reduced performance and/or capability. Although the motor 100 shown in FIGS. 1 and 4 comprises six coils 107, the skilled person will appreciate that electric motors can be constructed with other numbers of coils and that the countermeasure 200 will be similarly effective against such motors.

Figure 5:
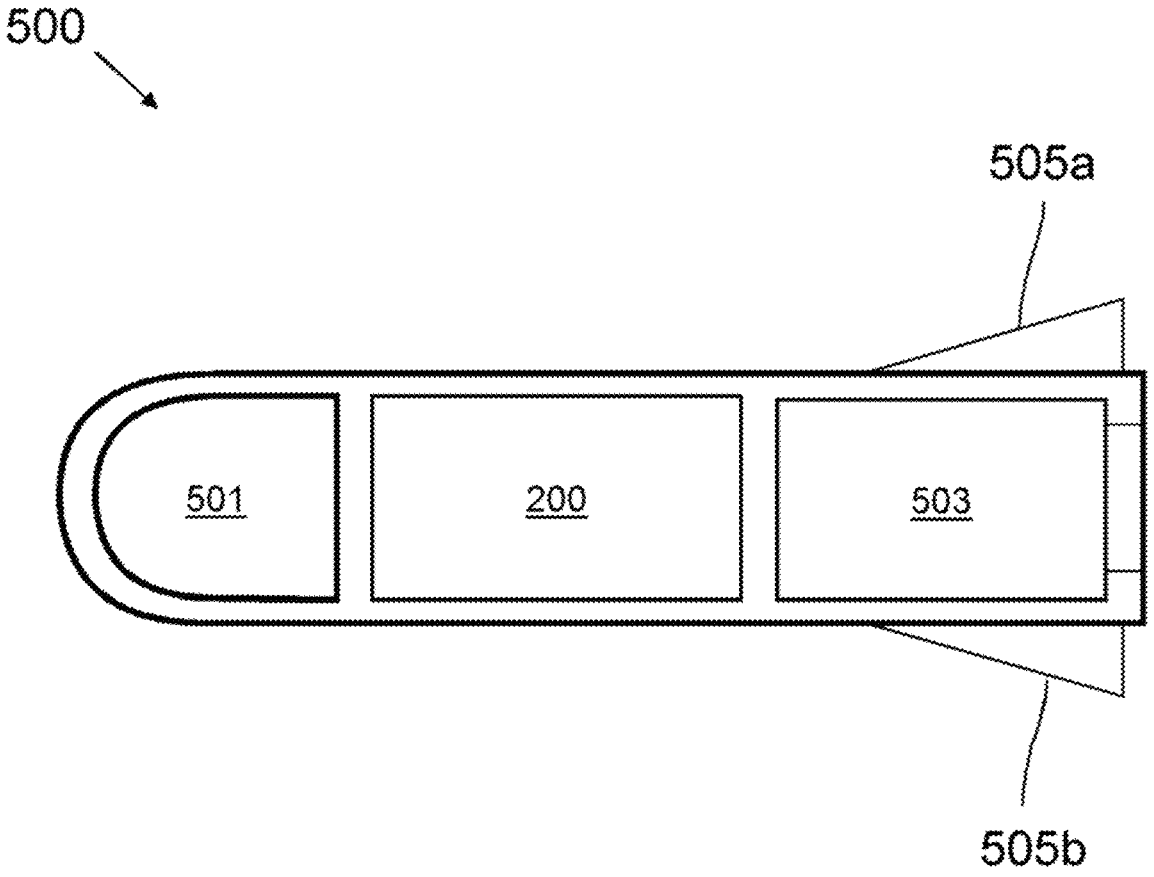
FIG. 5 shows a missile according to a third embodiment of the invention.

FIG. 5 shows a missile 500 according to a third embodiment of the invention. In some embodiments, the missile may comprise any of an anti-air missile, a ground attack missile, and a loitering munition. The missile 500 comprises a countermeasure 100 according to the first embodiment. In some embodiments, missile 500 further comprises a seeker 501. The seeker is configured to detect and track a target vehicle in order to provide guidance of the missile 500 to the target vehicle. In certain some embodiments, the seeker 501 provides some of all of the functions of the control system 211 of the first embodiment. For example, it may be that the seeker 501 detects the target vehicle and monitors the distance to the target vehicle.

It may be that missile 500 further comprises a motor 503. The motor 503 may comprise any of a rocket motor, a turbojet, and a turboprop or any other engine suitable for driving a propeller. The motor 503 serves to provide propulsion of the missile 500 to a target.

In some embodiments, missile 500 further comprises a plurality of control surfaces 505, for example control fins. In some embodiments, the control surfaces are moveable, for example by controllable actuators, in order to control the missile attitude. In some embodiments, the control surfaces 505 are controlled according to feedback from the seeker 501 on the relative positions of the missile 500 and the target vehicle. Thus, the seeker 501 and control surfaces 505 enable controlled guidance of missile 500 to the target vehicle.

In alternative embodiments, the missile 500 does not comprise a seeker 501 and comprises only fixed fins. For example, the missile 500 may comprise an unguided rocket.

Figure 6:
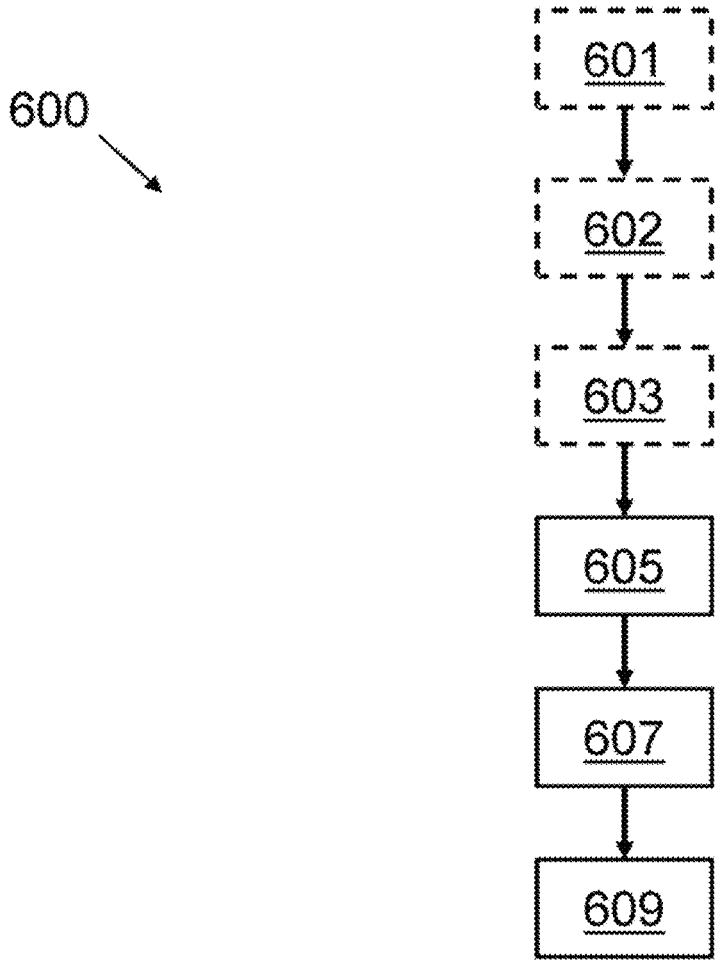
FIG. 6 shows a flow chart illustrating the steps of a method according to a fourth embodiment of the invention.

FIG. 6 shows a flow chart illustrating the steps of a method 600 according to a fourth embodiment of the invention.

An optional first step of the method 600, represented by item 601, comprises detecting a target vehicle. The target vehicle comprises an electric motor including at least one magnet. It may be that the target vehicle is propelled at least in part by the electric motor. For example, the target vehicle may be an aircraft, for example one of a rotary wing aircraft and a fixed wing aircraft. Thus, the electric motor may drive one or more propellers of the aircraft. The vehicle may comprise an unmanned air system (e.g. a drone). Alternatively, the target vehicle may be a ground vehicle, and the electric motor may drive one or more wheels or tracks of the ground vehicle.

An optional second step of the method 600, represented by item 602, comprises, in response to the detecting, launching the portion of the countermeasure containing the plurality of magnetic pieces in response to detection of the target vehicle.

An optional third step of the method 600, represented by item 603, comprises detecting that a trigger condition has been met and, in response to the detecting, transmitting a trigger signal to a dispersal system. In some embodiments, detecting that the trigger condition has been met comprises determining that a distance to the target vehicle has fallen below a pre-determined threshold. In some embodiments, detecting that the trigger condition has been met comprises determining that a pre-determined period of time has elapsed since launch.

An optional fourth step of the method 600, represented by item 605, comprises receiving, at the dispersal system, the trigger signal.

A fifth step of the method 600, represented by item 607, comprises, in response to the receipt of the trigger signal, the dispersal system releasing a plurality of pieces of magnetic material. In some embodiments, releasing the plurality of pieces comprises creating an airburst to disperse the plurality of pieces. In some embodiments, the dispersal system comprises a pyrotechnic charge and creating the airburst comprises detonating the pyrotechnic charge. In some embodiments, the dispersal system comprises a container of pressurised gas and creating the airburst comprises releasing the pressurised gas. In some embodiments the dispersal system comprises an ejection mechanism and creating the airburst comprises activating the ejection mechanism.

A sixth step of the method 600, represented by item 609, comprises some of the plurality of pieces being attracted to the magnet, sticking to the magnet, and thereby obstructing the motor. In some embodiments, being attracted to the magnet comprises being ingested into the electric motor through an air intake. In some embodiments, the electric motor further comprises a rotor, a stator, and an air gap between the rotor and the stator. In such embodiments, it may be that the plurality of pieces obstruct the motor by filling the air gap. In some embodiments, obstructing the motor comprises entirely blocking the motor. In alternative embodiments, obstructing the motor comprises hindering the rotation of motor.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

Although the present invention and the described embodiments are particularly useful in disrupting the operation of unmanned vehicles, and UAS especially, it will be appreciated that the invention is suitable for use against any vehicle having an open-vented electric motor, be it manned or unmanned. It will also be appreciated that the invention provides a general technique for disabling electric motors, and therefore may be usable against targets other than vehicles and/or for purposes other than disrupting the propulsion of a vehicle.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A countermeasure for use against a vehicle having an electric motor comprising at least one magnet, the countermeasure comprising:

a dispersal system containing a plurality of pieces of magnetic material, the dispersal system being configured to release the plurality of pieces in response to a trigger signal, and wherein the pieces of magnetic material consist essentially of iron filings.

2. A countermeasure according to claim 1, further comprising a control system, wherein the control system is configured to generate the trigger signal.

3. A countermeasure according to claim 2, wherein:

the control system comprises a proximity fuse, the proximity fuse being configured to generate the trigger signal in response to detecting that a distance to the vehicle has fallen below a pre-determined threshold; or the control system comprises a time-delay fuse, the time-delay fuse being configured to generate the trigger signal in response to a pre-determined period of time having elapsed since the countermeasure was launched.

4. A countermeasure according to claim 1, wherein the dispersal system comprises an ejection system configured to eject the plurality of pieces from the dispersal system.

5. A countermeasure according to claim 4, wherein the ejection system comprises one or more of: a pyrotechnic charge, pressurised gas and/or an ejection mechanism.

6. A countermeasure according to claim 1, wherein the dispersal system comprises a container within which the plurality of magnetic pieces are contained.

7. A countermeasure according to claim 6, wherein the container comprises one or more openings via which pieces of magnetic material can exit the container and the dispersal system comprises one or more lids mounted for movement relative to an opening between a first position in which the lid covers the opening and a second position in which the lid does not cover the opening.

8. A countermeasure according to claim 1, wherein the pieces are sized and shaped to be ingested into the electric motor.

9. A countermeasure according to claim 1, wherein the vehicle comprises an aircraft, for example one of: a rotary wing aircraft, a fixed wing aircraft, and an unmanned air system.

10. A countermeasure according to claim 8, wherein the vehicle comprises an unmanned air system less than 25 kg in mass.

11. A countermeasure according to claim 1, wherein:

the countermeasure is mounted on a missile or an aircraft; or the dispersal system forms part of a grenade.

12. A missile comprising a countermeasure according to claim 1.

13. A method of disrupting the operation of a vehicle having an electric motor comprising at least one magnet using a countermeasure comprising a dispersal system containing a plurality of pieces of magnetic material, the method comprising:

the dispersal system releasing the plurality of pieces in response to a trigger signal; and some of the plurality of pieces being attracted to the magnet and thereby obstructing the motor; and wherein the pieces of magnetic material consist essentially of iron filings.

14. A method according to claim 13, further comprising detecting that a trigger condition has been met and, in response to the detecting, transmitting the trigger signal to the dispersal system.

15. A method according to claim 14, wherein detecting that the trigger condition has been met comprises:

determining that a distance to the vehicle has fallen below a pre-determined threshold; or determining that a pre-determined period of time has elapsed since launch of the countermeasure.

16. A method according to claim 13, wherein being attracted to the magnet comprises being ingested into the electric motor through an air intake.

17. A method according to claim 13, wherein releasing the plurality of pieces comprises creating an airburst to disperse the plurality of pieces.

18. A method according to claim 17, wherein:

the dispersal system comprises a pyrotechnic charge and creating the airburst comprises detonating the pyrotechnic charge; or the dispersal system comprises a container of pressurised gas and creating the airburst comprises releasing the pressurised gas.

19. A method according to claim 13, wherein the electric motor further comprises a rotor, a stator, and an air gap between the rotor and the stator, and wherein the plurality of pieces obstruct the motor by at least partially filling the air gap.

20. A countermeasure for use against a vehicle having an electric motor comprising at least one magnet, the countermeasure comprising:

a dispersal system containing a plurality of pieces of magnetic material, the dispersal system being configured to release the plurality of pieces in response to a trigger signal, wherein the dispersal system comprises a container within which the plurality of magnetic pieces are contained, and wherein the container comprises one or more openings via which pieces of magnetic material can exit the container and the dispersal system comprises one or more lids mounted for movement relative to an opening between a first position in which the lid covers the opening and a second position in which the lid does not cover the opening.

* * * * *